US009956602B2

(12) United States Patent
Anagnostopoulos

(10) Patent No.: US 9,956,602 B2
(45) Date of Patent: May 1, 2018

(54) PRODUCTS, SYSTEMS, AND METHODS FOR PLACEMENT OF COVERS ON METALLIC SPACERS OF CONCRETE REINFORCEMENT

(71) Applicant: Antonios Anagnostopoulos, Attikis (GR)

(72) Inventor: Antonios Anagnostopoulos, Attikis (GR)

( * ) Notice: Subject to any disclaimer, the term of this patent is extended or adjusted under 35 U.S.C. 154(b) by 357 days.

(21) Appl. No.: 14/431,769

(22) PCT Filed: Sep. 27, 2013

(86) PCT No.: PCT/IB2013/058924
§ 371 (c)(1),
(2) Date: Mar. 28, 2015

(87) PCT Pub. No.: WO2014/049559
PCT Pub. Date: Apr. 3, 2014

(65) Prior Publication Data

US 2015/0239031 A1 Aug. 27, 2015

(30) Foreign Application Priority Data

Sep. 28, 2012 (GR) ..... 120100516

(51) Int. Cl.
*B21F 27/14* (2006.01)
*B21F 5/00* (2006.01)
(Continued)

(52) U.S. Cl.
CPC ..... *B21F 5/00* (2013.01); *B21F 27/14* (2013.01); *E04C 5/015* (2013.01); *E04C 5/161* (2013.01); *B21F 27/12* (2013.01)

(58) Field of Classification Search
CPC .. B21F 5/00; B21F 27/12; B21F 27/14; E04C 5/015; E04C 5/161; E04C 5/165; B21D 7/06; B21K 1/56
See application file for complete search history.

(56) References Cited

U.S. PATENT DOCUMENTS 4,231,152 A * 11/1980 Kubota ..... H01C 1/148 29/525
5,469,679 A * 11/1995 Burkard ..... B65C 11/00 138/96 R
(Continued)

FOREIGN PATENT DOCUMENTS

DE 1609659 A1 7/1970
DE 3935655 C1 11/1990
(Continued)

OTHER PUBLICATIONS

Blum; 2000; EP 1 048 798 Machine Translation.*
(Continued)

*Primary Examiner* — Jacob Cigna
*Assistant Examiner* — Lee A Holly
(74) *Attorney, Agent, or Firm* — Andrew F. Young, Esq.; Lackenbach Siegel, LLP

(57) ABSTRACT

A product cover for the end of wire (1) of spacer meshes, and a processes and a systems for cover placement on ends of said wires (1), The wire ends of transverse wires are formed in a manner resulting in indentations and protrusions on their surfaces, so that the placement of a cover induces flow of its plastic material and creates a stable joining. Covers are serially guided inside a guide so that one of them is guided to a rotor. This rotor is then rotated to line up with the wire and a plunger for placement of the cover. Then, by the action of the plunger, this cover is pushed until fitted on the end of the wire.

7 Claims, 8 Drawing Sheets

(51) Int. Cl.

| | |
|---|---|
| ***E04C 5/01*** | (2006.01) |
| ***E04C 5/16*** | (2006.01) |
| *B21F 27/12* | (2006.01) |

(56) References Cited

U.S. PATENT DOCUMENTS

| | | | | |
|---|---|---|---|---|
| 6,199,333 | B1 | 3/2001 | Viduka | |
| 6,915,572 | B1 * | 7/2005 | Ritter | B21F 27/128 29/430 |

FOREIGN PATENT DOCUMENTS

| | | | | |
|---|---|---|---|---|
| DE | 4417060 | A1 | 11/1995 | |
| EP | 0442010 | A1 | 2/1990 | |
| EP | 0875308 | A2 | 11/1998 | |
| EP | 1048798 | A1 * | 11/2000 | B21F 5/00 |
| EP | 2 916 975 | | 2/2017 | |
| FR | 2238825 | A1 | 2/1975 | |
| GB | 1117341 | A | 6/1968 | |
| JP | 2001-020460 | A | 1/2001 | |
| JP | 2005-320833 | A | 11/2005 | |
| WO | 2006/043844 | A1 | 4/2006 | |
| WO | 2006/097100 | A1 | 9/2006 | |

OTHER PUBLICATIONS

EPO Decision to Grant European Patent (dated Jan. 26, 2017), Letter of Intent to Grant EPO Patent (dated Sep. 7, 2016) and granted Claims—from counterpart EP13811007 Application.

PCT-ISR search report and written opinion from priority PCT applicationPCT/IB2013/058924, dated Mar. 4, 2014; in English.

Search report of the Greek (GR) National Patent Office in priority application GR20120100516, report dated Nov. 26, 2013; discussed in Applicant's transmittal letter (comments translated).

* cited by examiner

PRODUCTS, SYSTEMS, AND METHODS FOR PLACEMENT OF COVERS ON METALLIC SPACERS OF CONCRETE REINFORCEMENT

This application is a 35 U.S.C. 371 national-phase entry of PCT International application no. PCT/IB2013/058924 filed on Sep. 27, 2013 and also claims benefit of priority to prior Greek national application no. GR20120100516 filed on Sep. 28, 2012, and Greek application no. GR20120100516 as well as parent PCT International application no. PCT/IB2013/0589247 are incorporated herein by reference in their entireties for all intents and purposes, as if identically set forth in full herein.

TECHNICAL FIELD

The present disclosure relates to products that are plastic covers placed at the ends of rods of spacer sections that are in turn placed within concrete for the upright placement of the reinforcement. The present disclosure relates to methods of placement of the covers on the rod ends, as well as to systems for placement of the covers on the rod ends.

BACKGROUND ART

The wire reinforcement is typically placed within wooden or metallic forms so as to be spaced at particular distances from the surfaces of the reinforced concrete. For this purpose, there exist spacing meshes which typically comprise small diameter wires that are bent in particular forms so as to be placeable as spacers. Such spacers are situated with their ends on the wooden or metallic form, and thus, after the hardening of the concrete, their ends remain in contact with the environment at the hardened cement's surface. At such locations of contact with the environment, the spacer steel corrodes. As a result of the corrosion progressing to the interior of the reinforced concrete, the steel expands and crumbles the concrete.

In previous attempt to avoid the onset of metal corrosion, the ends of the spacer wires were dipped into resins or plastic, typically in liquid form at high temperature, and were subsequently cooled by air flow that may include forced air. This technique is disadvantageous with respect to complexities of the liquid phase of the cover material, as well as with respect to the time for cooling and solidification of the cover material.

Another technique is the placement of prefabricated plastic covers on the wire ends by mechanisms. According to such state-of-art practices, a significant number of covers fall during handling of the spacer meshes, during transfer, during placement, and during casting of the cement; and thus, the possibility for corrosion remains.

SUMMARY OF INVENTION

Technical Problem

This state of the art in placement of covers on the rod ends, referred to above, is not entirely satisfactory with regards to steady and secure placement of the covers on the ends of the wires in an automated and economical way. Thus, the existing state of the art may be understood as disadvantageous for at least reasons indicated in the preceding paragraphs.

Solution to the Problem

The present disclosure presents products, as covers with specialized formations, and methods for secure placement of covers on the ends of spacer meshes, as well as systems that implement such methods leading to steady and secure placements of covers on the ends of the wires in an automated and economical way.

Advantageous solutions may be found via systems that place covers on ends of wires of spacer meshes and include a formation press for the ends of transverse wires, this formation press being situated along the length of a production line for spacer meshes to produce indentations and protrusions on the ends of the wires, and wherein a subsequently-situated feeding unit for covers places the covers on the ends of the transverse wires. In addition to this solution, a further solution may provide that the formation press for the indentations on the ends of the transverse wires may embody movable and stationary tools and be driven by a hydraulic cylinder. Optionally to either version of solution, there may be a cover feeding mechanism with an approach guide for guiding covers in the perpendicular direction inside the approach guide towards a rotor, this rotor being rotatable to orientate the cover in the direction of the ends of the transverse wires of a mesh; and furthermore a plunger pushing the cover onto the end of the transverse wire, with respective pneumatic cylinders driving the rotor and the plunger respectively. Particularly to this latter stated solution, a yet further developed solution provides that the rotor has a receiver of dimensions corresponding to the dimensions of the cover and has two positions, with one position being towards the top for receiving a cover from the feed guide, and, one position being horizontal for feeding the cover towards an end of the wire.

Considering all of the above-indicated solutions, there may be developed further solutions with one or more presses simultaneously forming an equal number of ends, and, an equal number of cover feeding mechanisms placing an equal number of covers on wire ends. Finally as an option, an electronic computer may control any of the indicated solution systems and generate all of the working phases simultaneously.

Advantageous solutions may be found via methods for placement of covers on ends of wires of spacer meshes that initially guide covers in a perpendicular direction in an approach guide towards a rotor, that rotate one cover from the direction of the approach guide to a direction of placement on the end of a wire, that push the cover via plunger, and, that position the cover on the end of the wire. In addition to this solution, a further solution may provide simultaneous feeding of more than one cover to a corresponding number of more than one ends of transverse wires. Optionally to either above-stated, in this paragraph, version of solution, there may be simultaneously formed one or more ends with an equal number of presses.

Advantageous solutions may be found in product covers for the ends of wire of a spacing mesh where the ends of the wires are formed with indentations and protrusions so that with the placement of the cover its material flows towards the protrusions and indentations of the end of the wire to create a stable joint. In addition to this solution, a further solution may provide the transverse wire being formed with indentations and protrusions that are perpendicular or angled relative to the axis of the wire, either sectionally or continuously on the periphery, or, alternatively the transverse wire being formed with indentations and protrusions that are parallel relative to the axis of the wire, again either sectionally or continuously on the periphery. In any of the versions of solutions stated in this paragraph, the material of the cover may be plastic, synthetic, or other suitable material. Optionally to any version of solution stated preceding in this paragraph, a blind opening of the cover may be slightly smaller than the diameter of wire end upon which it is placed.

According to the present disclosure, this may be achieved by systems, by methods, and by products having the features conveyed by the present disclosure and appended drawings. Advantageous configurations and further developments are also evident from the description in combination with the figures of the drawings.

Advantageous Effects

The present disclosure provides systems, methods, and products that may be understood to present significant advantages. For example, versions of systems according to the present disclosure may be manufactured in stations so as to be simply adaptable in a large range of machines producing spacer meshes. Versions of systems according to the present disclosure may guide the covers and rotate them prior to the final supplying, thereby precluding failure during cover placement. Furthermore, versions of systems according to the present disclosure may produce indentations and protrusions on the ends of the wires, leading the plastic materials of a cover to flow so that the covers cannot randomly separate from the wire.

The present disclosure also provides methods of manufacturing at stations in a manner simply adaptable to a large range of spacer mesh production processes. Versions of methods according to the present disclosure provide steps of guiding and rotating the covers prior to the final supplying, thereby precluding failure during steps of cover placement. Furthermore, versions of methods according to the present disclosure may include steps of producing indentations and protrusions on wire ends, leading the plastic materials of a cover to flow so that the covers cannot randomly separate from the wire.

The present disclosure also provides versions of products having covers that are positioned on wire's formed end firmly, so as to not disconnect during handling of the material.

BRIEF DESCRIPTION OF THE DRAWINGS

Aspects of systems, methods, and products according to the present disclosure may be understood from the following detailed description and from the attached drawings, wherein methods and systems are presented in an exemplary manner, and where parts which are the same or similar are provided with the same or similar reference numeral labels.

FIG. 5B—a top elevation view of the same mechanism of FIG. 5A;

DESCRIPTION

Figure 1A:
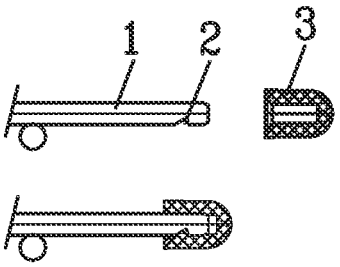
FIG. 1A—depicts a first version of wire end formations with cover.
Figure 1D:
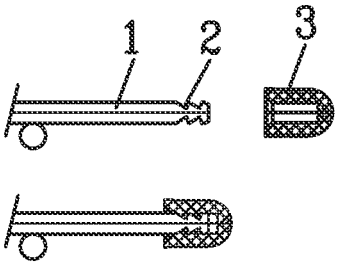
FIG. 1D—similarly depicts a fourth version of wire end formations with cover.
Figure 1B:
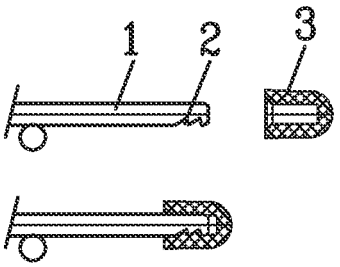
FIG. 1B—depicts a second version of wire end formations with cover.
Figure 1E:
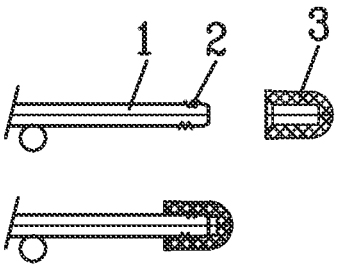
FIG. 1E—similarly depicts a fifth version of wire end formations with cover.
Figure 1C:
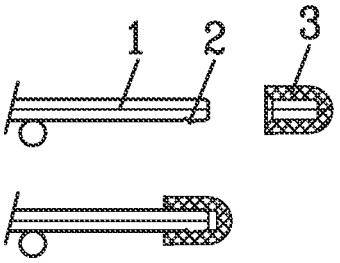
FIG. 1C—similarly depicts a third version of wire end formations with cover.
Figure 1F:
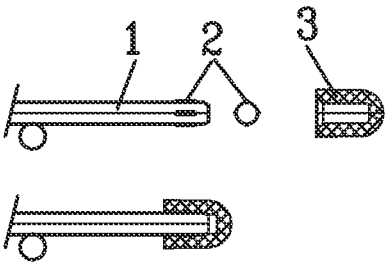
FIG. 1F—similarly depicts a sixth version of wire end formations with cover.

In following is presented description of exemplary implementations of systems, methods, and products, in the sense of non-limiting examples. At this point, it is pointed out that, in the context of the present disclosure, either one of the terms "wire" and "rod" can equivalently be understood as meaning or indicating, in the context of the present disclosure, claims, and appended drawings, either wire and/or rod; as in implementations of the invention the material employed, as well as the dimension of the individual elements, may be commensurate with the requirements of particular applications.

Product

First turning to FIGS. 1A-1F, it should be understood that a subject product cover 3 is manufactured from plastic. However, the material of the product cover 3 may be plastic, synthetic, or other suitable material. The depicted blind opening of cover 3 is slightly smaller than the diameter of wire 1 end upon which it is placed.

The wire 1 at its end, and within the region upon which is placed the cover 3, is formed with at least one formation 2 which creates protrusions and indentations on the wire, as depicted in all of FIGS. 1A-1F. With the placement of the cover 3 onto the end of the wire 1 the plastic material of the cover 3 flows into the indentations and around the protrusions so that the cover 3 is stabilized on the end of the wire 1.

The ends of the wires 1 are formed with indentations 2 and protrusions 2 so that with the placement of the cover 3 its material flows towards the protrusions 2 and indentations 2 of the end of the wire 1, and there is created a stable joint. As FIGS. 1A-1F depict, these protrusions and indentations 2 of the wire 1 may be one, as in FIG. 1A, or more as depicted for example in FIGS. 1D, 1B. They may be straight sections perpendicular to the axis of the wire 1 or with inclination relative thereto, or parallel relative to the axis of the wire 1 as in FIG. 1F. They may be of curved form, or embody perimetric formation as for example in FIG. 1E threaded. However, in each case there are indentations and/or protrusions 2 on the wire so that the material of the cover 3 flows to stabilize it on the wire 1. Similarly, when the product cover 3 on the ends of wires 1 of a spacing mesh 1*a* as depicted in FIGS. 6-7, the transverse wire 1 similarly may be formed with indentations 2 and protrusions 2 perpendicular, angled or parallel relative to the axis of the wire 1, sectionally or continuously on the periphery.

Method

Figure 6:
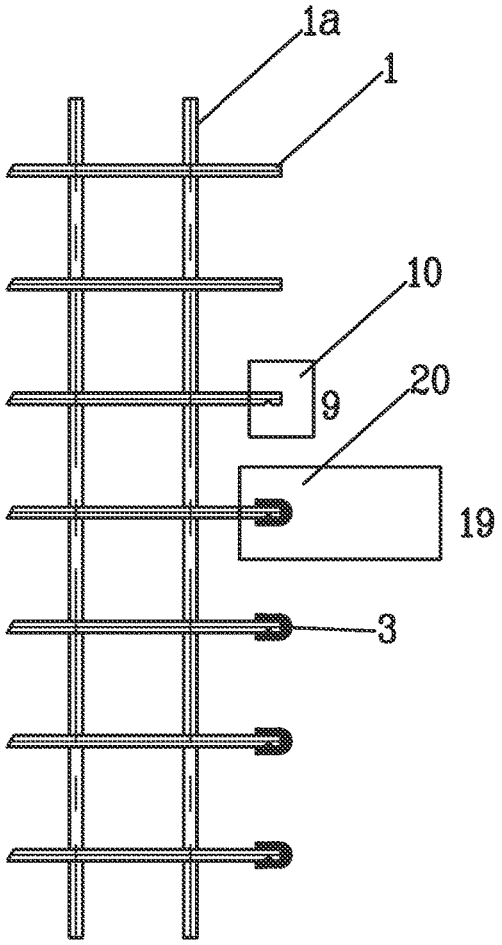
FIG. 6—a first version of a line for placement of a cover.
Figure 7:
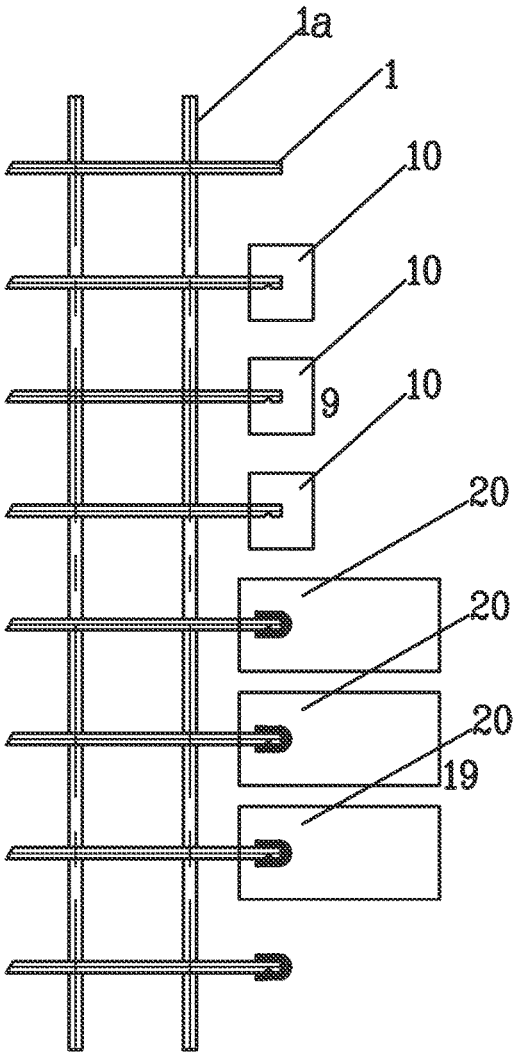
FIG. 7—a second version of line for simultaneous placement of three covers.

Having first described exemplary products in the preceding discussion, it is instructive to next consider exemplary methods for placement of covers 3 on the ends of wires 1 of spacer meshes 1*a*. According to versions of exemplary methods, the covers 3 are disposed on the ends of the wires 1 in the following manner:

As depicted in FIGS. 6-7, the respective ends of the wires 1 are situated at the respective side of a produced mesh 1*a* that originates in an automated mesh producing machine.

Figure 2:
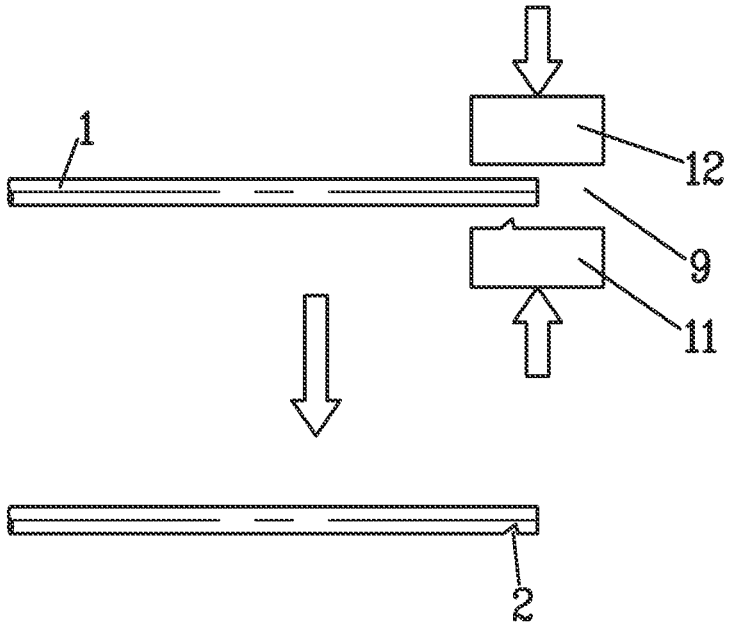
FIG. 2—schematically depicts beginning of forming operation at end of wire, and the result, at formation station.

Turning to FIG. 2 in particular, it may be understood from this schematic depiction that as a mesh 1*a* is produced, the ends of the wires 1 are formed in a station 9 along the length of the machine, for example during the duration of time of the welding of the transverse wires on the longitudinal wires. The ends of the wires 1 upon which the covers 3 are placed are formed by the pressure of a movable tool 11 upon a stationary tool 12, and there are produced indentations 2 and/or protrusions 2 as previously referred to in the description of the product.

With the aid of the understanding produced from the FIG. 2 isolation, turning attention again to FIGS. 6-7 explains further that in another station 19 situated after the ends formation station 9 and along the length of the direction of production of the mesh 1*a*, there are placed the covers 3 on the ends of the wires 1. In subsequent detailed explanation it shall be explained that the covers 3 are guided in series and with the correct orientation towards the ends of wires 1, initially inside a guide 23 perpendicular to the direction of the plunger 21.

Indeed, with reference to FIGS. 3A-3F, in the lower portion of this guide 23 there is a cylindrical rotor 22 able to receive only one cover 3 from the guide 23. The rotor 22 is through-bored and rotatable relative to its own axis that coincides with the section of the axis of the feed guide 23 of the covers and the direction of the plunger 21.

Figure 3A:
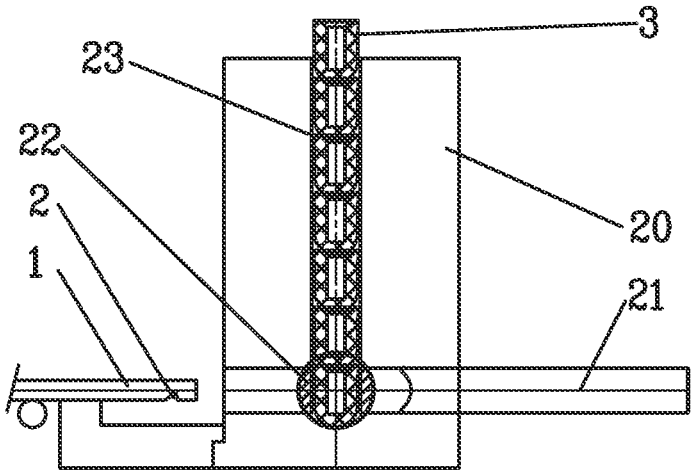
FIG. 3A—depicts cover feeding mechanism in first disposition in the method.
Figure 3B:
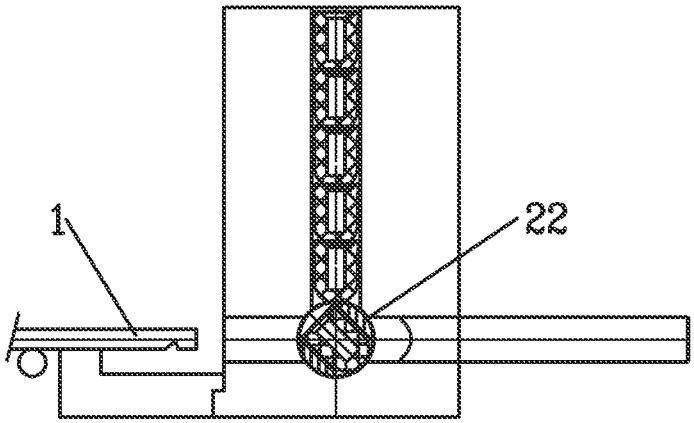
FIG. 3B—depicts cover feeding mechanism in second disposition in the method.
Figure 3C:
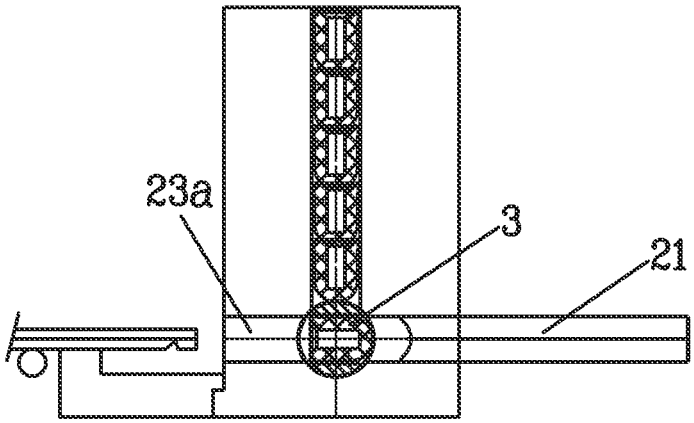
FIG. 3C—depicts cover feeding mechanism in third disposition in the method.
Figure 3D:
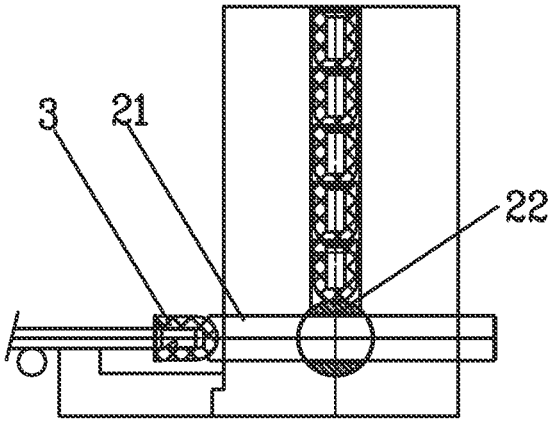
FIG. 3D—depicts cover feeding mechanism in fourth disposition in the method.

As depicted in FIGS. 3B-3C, by rotating the receiver 22*a* to 90° the cover 3 assumes a position in the direction of plunger 21. The end of wire 1 on which the cover 3 is to be placed is already located at the axis of plunger 21. As depicted in FIG. 3D, subsequently the plunger 21 is driven and pushes the cover 3 onto the end of wire 1. Thus, in summary of FIGS. 3A-3D, the covers 3 are initially guided in the perpendicular direction in an approach guide 23 towards a rotor 22*a* that rotates one cover 3 from the direction of the approach guide 23 to the direction of placement 23*a* onto the end of the wire 1. This rotated cover 3 is then pushed by the plunger 21 and positioned on the end of the wire 1.

Figure 3E:
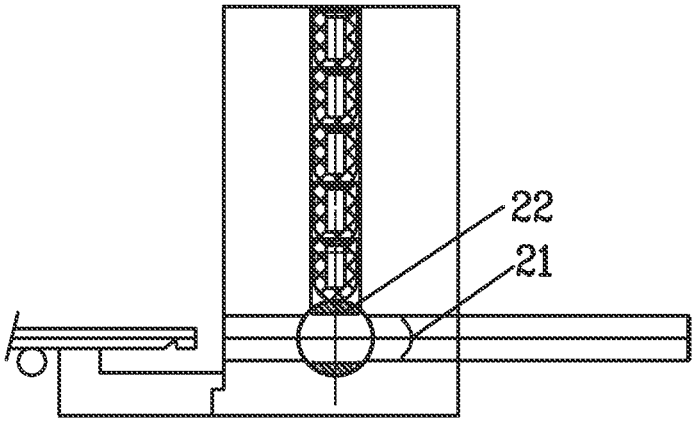
FIG. 3E—depicts cover feeding mechanism in fifth disposition in the method.
Figure 3F:
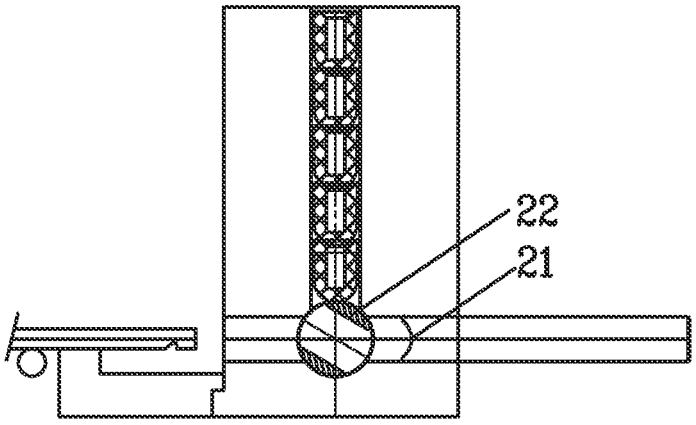
FIG. 3F—depicts cover feeding mechanism in sixth disposition in the method.

To complete, as depicted in FIG. 3E, in following, the plunger 21 returns to its initial position. Continuing to FIG. 3F, the receiver 22*a* rotates to its initial position, a new end of a wire 1 is transferred to the axis of the plunger 21 and the operational cycle is repeated.

The formation of the ends and the feeding of the cover 3 may be made per cover 3, each time, as depicted in FIG. 6. However, there may also be formed simultaneously more than one end of wire 1 with simultaneous feeding 19 of a corresponding number of covers 3, and this is depicted in FIG. 7. Thus, FIG. 7 schematically depicts that there are simultaneously respectively fed more than one respective covers 3 to a corresponding number of more than one respective ends of transverse wires 1.

System

In the context of present disclosure, it should be understood at this point that exemplary systems described include mechanisms for placement of covers 3.

Returning to FIGS. 6-7 for context, along the length of a production line for spacer mesh 1*a*, and located after the welding head (that need not be depicted) for the transverse upon the longitudinal wires, there are situated the station 9 for forming the end of the rod 1 and subsequently the station 19 for placement of the covers 3 upon the ends of the transverse wires 1. In this context, it should also be immediately understandable that the formation 2 of the ends 1 and the placement of the covers 3 may occur simultaneously with the welding (that need not be depicted) of the transverse wires onto the longitudinals.

Figure 4B:
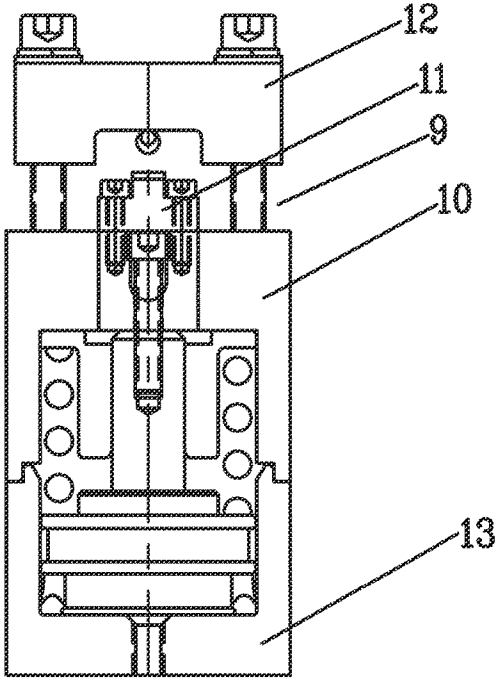
FIG. 4B—is a second elevational view rotated 90° relative to FIG. 4A again depicting formation press with cylinder in partial section.
Figure 4A:
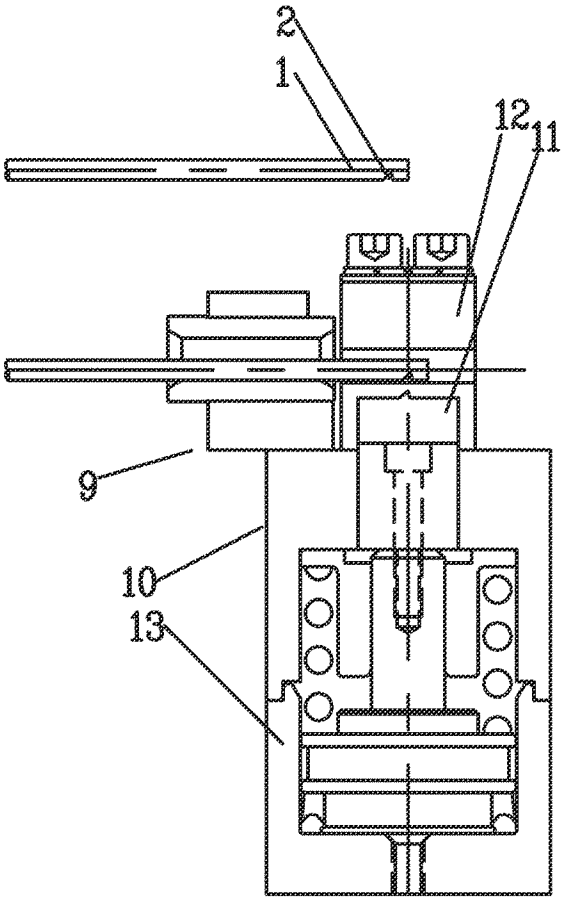
FIG. 4A—is an elevational view of the formation press with cylinder in partial section.

The formation of the ends occurs with formation press 10 that disposes formation tools 11,12 one of which is movable. As depicted in detail in FIGS. 4A-4B, the movable tool 11 is moved by a hydraulic cylinder 13 that exercises sufficient forces for the formation of the indentations 2 on the end of the wire 1. The cylinder 13 of the press is activated by a hydraulic valve (that need not be depicted).

Thus, versions of exemplary systems for placement of covers 3 on the ends of wires 1 situate a formation press 10, along the length of a production line, for the ends of transverse wires 1 so that there result indentations and protrusions 2. Subsequently, feeding unit 20 for covers 3 places covers 3 on ends of the transverse wires 1 of a spacer mesh 1 *a*. It should be understood that the system may be controlled by an electronic computer and all of its working phases may be generated automatically. One or more ends 1 may be formed simultaneously from an equal number of presses 10, and the same number of covers 3 are placed on the ends of the wire 1 by an equal number of cover 3 feeding mechanisms 20.

Figure 5A:
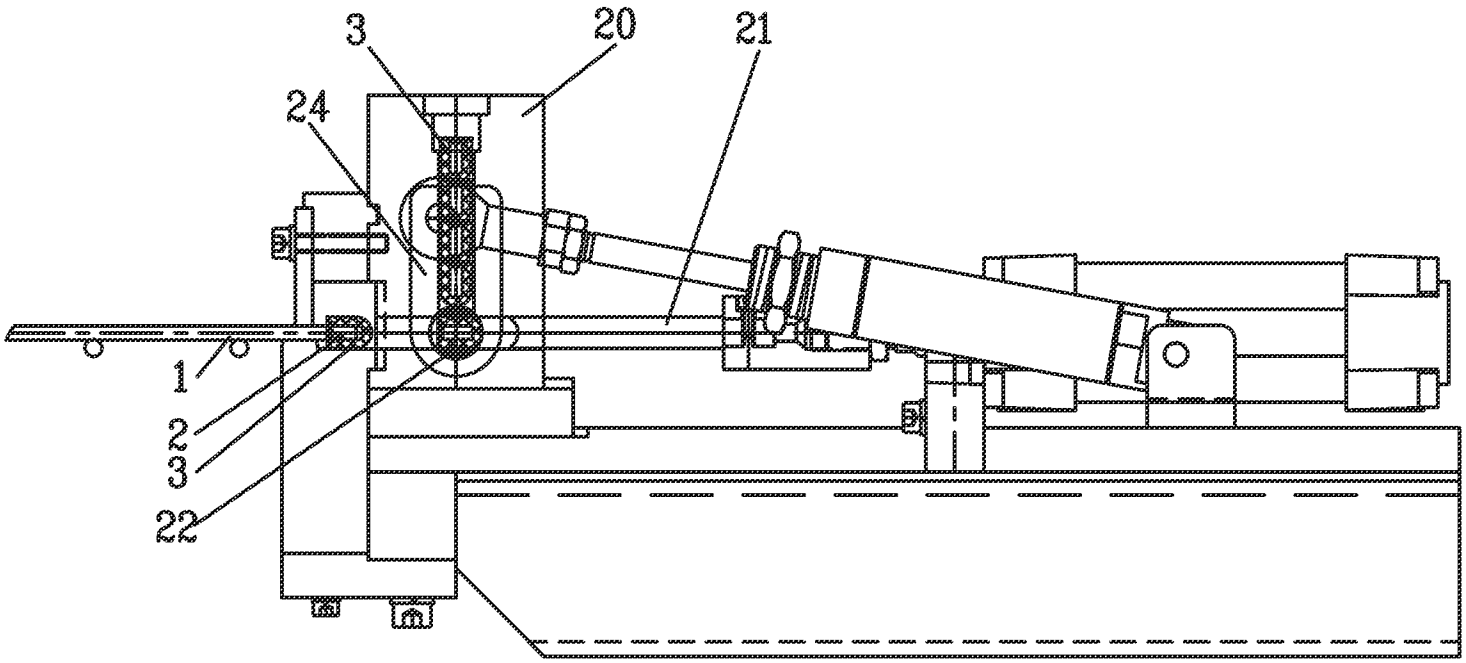
FIG. 5A—a side elevation view of the mechanism for cover placement.
Figure 5B:
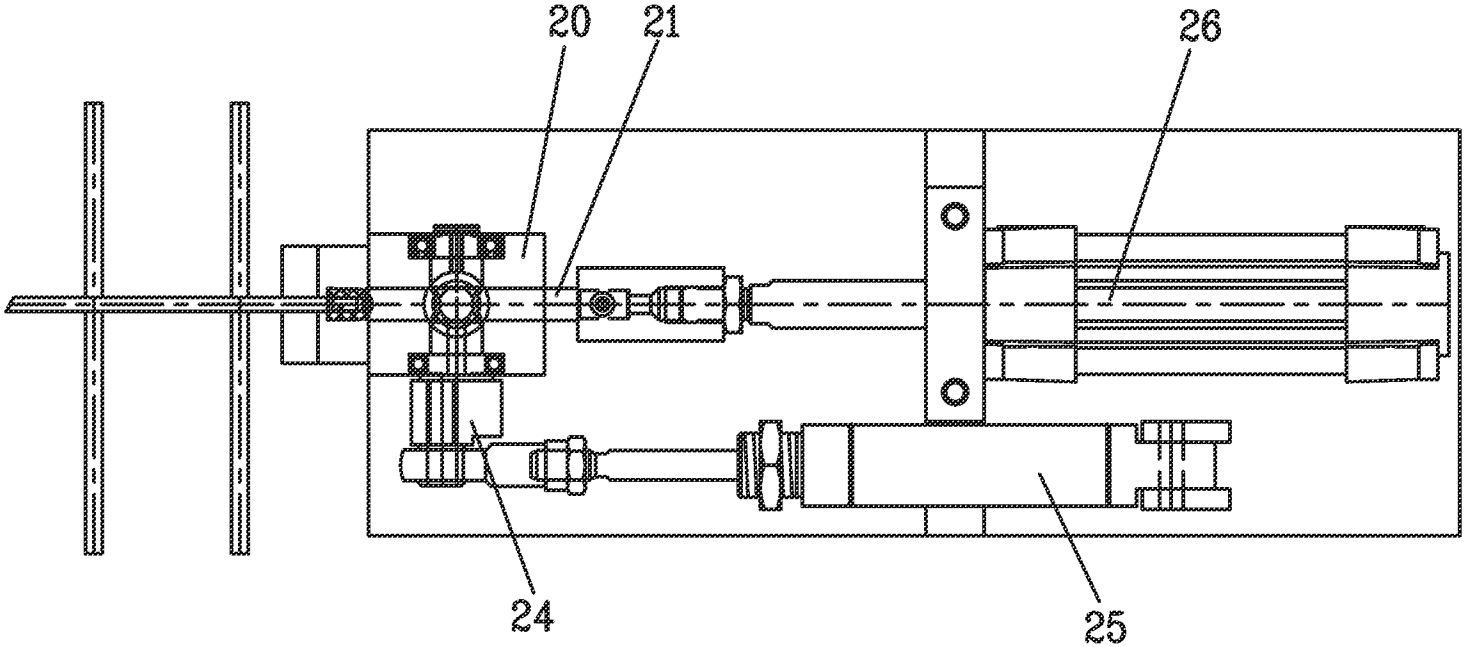

The placement of the covers 3 occurs at the placement station 19. The covers 3 are guided in the perpendicular direction in series, as depicted in FIG. 3A inside the guide 23 of cover feeding mechanism 20. In the mechanism 20 base there is a rotor 22 with a receiver 22*a* of dimensions corresponding to the dimensions of the cover 3, and having two positions. Considering FIGS. 3A and 3C, one position is towards the top for receiving a cover 3 from the feed guide 23 and one horizontal for feeding 23*a* the cover 3 towards the end of the wire 1. FIGS. 5A-5B depict the rotor 22*a* to be rotated from the air cylinder 25 through the lever 24.

Again having reference to FIG. 3C, and in greater detail, in the horizontal direction of the rotor's 22 receiver 22*a* there is a plunger 21 that pushes the cover 3 through a guide 23*a* to the end of wire 1, and places this cover 3 on the end of the wire 1. As depicted in detail in FIGS. 5A-5B, the motion of the plunger 21 is effected by a pneumatic cylinder 26 that is driven by a directional valve (that need not be depicted).

Thus, the covers 3 may be guided in the perpendicular direction inside the approach guide 23 towards the rotor 22 that is rotated so as to orientate the cover 3 in the direction of the ends of the transverse wires 1 of a mesh 1*a*, with the plunger 21 pushing the cover 3 onto the end of the mesh 1*a*, and with the rotor 22 and the plunger 21 being driven by pneumatic cylinders 25,26.

It should be understood in the context of the preceding discussion that the present invention is not limited in any manner to the described and drawings-depicted implementations, but may be realized in many forms and dimensions without abandoning the region of protection of the invention. For example, in implementations of the invention the materials that are used and also as well the dimensions of particular elements may be according to the demands of a particular construction. Thus, in closing, it should be noted that the invention is not limited to the abovementioned versions and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not necessarily limiting upon the scope of the present invention. The scope of the present invention is defined by the appended claims, including known equivalents and unforeseeable equivalents at the time of filing of this application.

REFERENCE LABELS LIST

1 wire (rod)
1*a* mesh
2 formations (protrusions/indentations)
3 covers
9 formation station
10 press
11 movable tool
12 stationary tool
13 hydraulic cylinder
19 cover placement station
20 cover feeding mechanism
21 plunger
22 cylindrical rotor
22*a* receiver
23 feed (approach) guide
23*a* guide to wire end
24 lever
25 air cylinder
26 pneumatic cylinder

What is claimed is:

1. A system for placement of wire-end covers, comprising:

a formation press configured to shape wire ends, producing indentations and protrusions on the wire ends, said formation press being situated along a spacer-mesh production line; and, a cover feeder configured to place covers on shaped wire ends produced by said formation press, said cover feeder being situated along said spacer-mesh production line subsequent to said formation press.

2. A system for placement of wire-end covers as claimed in claim 1, further comprising:

at least one stationary tool included in said formation press.

3. A system for placement of wire-end covers as claimed in claim 2, further comprising:

at least one movable tool included in said formation press.

4. A system for placement of wire-end covers as claimed in claim 2, further comprising:

a fluid powered motor operatively connected to drive said formation press.

5. A system for placement of wire-end covers as claimed in claim 1, further comprising:

a cover-feeding mechanism, said cover-feeding mechanism including an approach guide configured to guide covers in a first direction inside said approach guide;

a rotor situated to receive covers from said approach guide, said rotor being rotatable to orientate received covers to a second, alignment direction;

a first fluid-powered cylinder operatively connected to drive said rotor;

a plunger configured to controllably push covers onto shaped wire ends; and, a second fluid-powered cylinder operatively connected to drive said plunger.

6. A system for placement of wire-end covers as claimed in claim 5, further comprising:

a receiver in said rotor, said receiver having dimensions corresponding to cover dimensions;

said rotor having at least two operative positions;

one of said at least two rotor operative positions aligning said receiver with said approach guide; and, a second of said at least two rotor operative positions aligning said receiver with said plunger.

7. A system for placement of wire-end covers as claimed in claim 1, further comprising:

a plurality of said formation presses configured to shape wire ends; and, a plurality of said cover feeders equal in number to said plurality of formation presses, said plurality of cover feeders and said plurality of formation presses being situated along spacer-mesh production line.

* * * * *